US010180639B2

(12) United States Patent
Fujii et al.

(10) Patent No.: US 10,180,639 B2
(45) Date of Patent: Jan. 15, 2019

(54) CARTRIDGE AND LID MEMBER FOR CARTRIDGE

(71) Applicant: BROTHER KOGYO KABUSHIKI KAISHA, Nagoya-shi, Aichi-ken (JP)

(72) Inventors: Yasumasa Fujii, Chiryu (JP); Hiroki Mori, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/526,636

(22) Filed: Oct. 29, 2014

(65) Prior Publication Data

US 2015/0117907 A1 Apr. 30, 2015

(30) Foreign Application Priority Data

Oct. 31, 2013 (JP) ..... 2013-227751

(51) Int. Cl.
*G03G 15/08* (2006.01)

(52) U.S. Cl.
CPC ..... *G03G 15/0887* (2013.01); *G03G 15/087* (2013.01); *G03G 15/0865* (2013.01); *G03G 15/0881* (2013.01); *G03G 15/0886* (2013.01); *G03G 2215/0692* (2013.01)

(58) Field of Classification Search
CPC ..... G03G 15/0832; G03G 15/0836; G03G 15/0841; G03G 15/0843; G03G 15/0865; G03G 15/087; G03G 15/0881; G03G 15/0886; G03G 2215/0692
See application file for complete search history.

(56) References Cited

U.S. PATENT DOCUMENTS

| | | | | |
|---|---|---|---|---|
| 6,219,506 | B1 | 4/2001 | Morinaga et al. | |
| 2005/0196198 | A1 | 9/2005 | Kawamura et al. | |
| 2006/0171737 | A1 | 8/2006 | Nishimura et al. | |
| 2012/0045244 | A1* | 2/2012 | Komatsu | G03G 15/0839 399/119 |

(Continued)

FOREIGN PATENT DOCUMENTS

| | | | |
|---|---|---|---|
| CN | 103135405 | A | 6/2013 |
| EP | 2 169 475 | A1 | 3/2010 |

(Continued)

OTHER PUBLICATIONS

Extended European Search Report issued in related Patent Application No. EP14190780.8, dated Apr. 20, 2015.

(Continued)

*Primary Examiner* — Joseph S Wong
(74) *Attorney, Agent, or Firm* — Merchant & Gould P.C.

(57) ABSTRACT

There is provided a cartridge, including: a casing including an inlet portion configured to be filled with a developer; and a lid member configured to close the inlet portion by being installed to the inlet portion from an installation direction, wherein the casing includes a first protruding portion which projects inward beyond an inner surface of the inlet portion in a direction perpendicular to the installation direction; and the lid member includes a recessed portion which is recessed from an outer surface of the lid member in the direction perpendicular to the installation direction and is configured to be engaged with the first protruding portion in a case that the lid member is installed to the inlet portion.

16 Claims, 10 Drawing Sheets

(56) References Cited

U.S. PATENT DOCUMENTS

| | | | | |
|---|---|---|---|---|
| 2012/0213555 | A1 | 8/2012 | Komatsu et al. | |
| 2013/0089357 | A1* | 4/2013 | Itabashi ..... | G03G 15/0886 399/106 |
| 2013/0136490 | A1* | 5/2013 | Itabashi ..... | G03G 15/0832 399/106 |

FOREIGN PATENT DOCUMENTS

| | | | |
|---|---|---|---|
| JP | 11-338238 | A | 12/1999 |
| JP | 2000-137375 | A | 5/2000 |
| JP | 2000-172057 | A | 6/2000 |
| JP | 2002-006607 | A | 1/2002 |
| JP | 2002-6607 | A | 1/2002 |
| JP | 2005-178810 | A | 7/2005 |
| JP | 2006-208837 | A | 8/2006 |
| JP | 2013-083684 | A | 5/2013 |

OTHER PUBLICATIONS

Notice of Reasons for Rejection issued in related Japanese Patent Application No. 2013-227751, dated Dec. 7, 2016.
European Office Action issued in EP application No. 14190780.8, dated Mar. 21, 2018.
Office Action issued in related Chinese Patent Application No. 201410602624.0, dated Jul. 31, 2018.

* cited by examiner

UPPER-REAR
RIGHT
LEFT
LOWER-FRONT

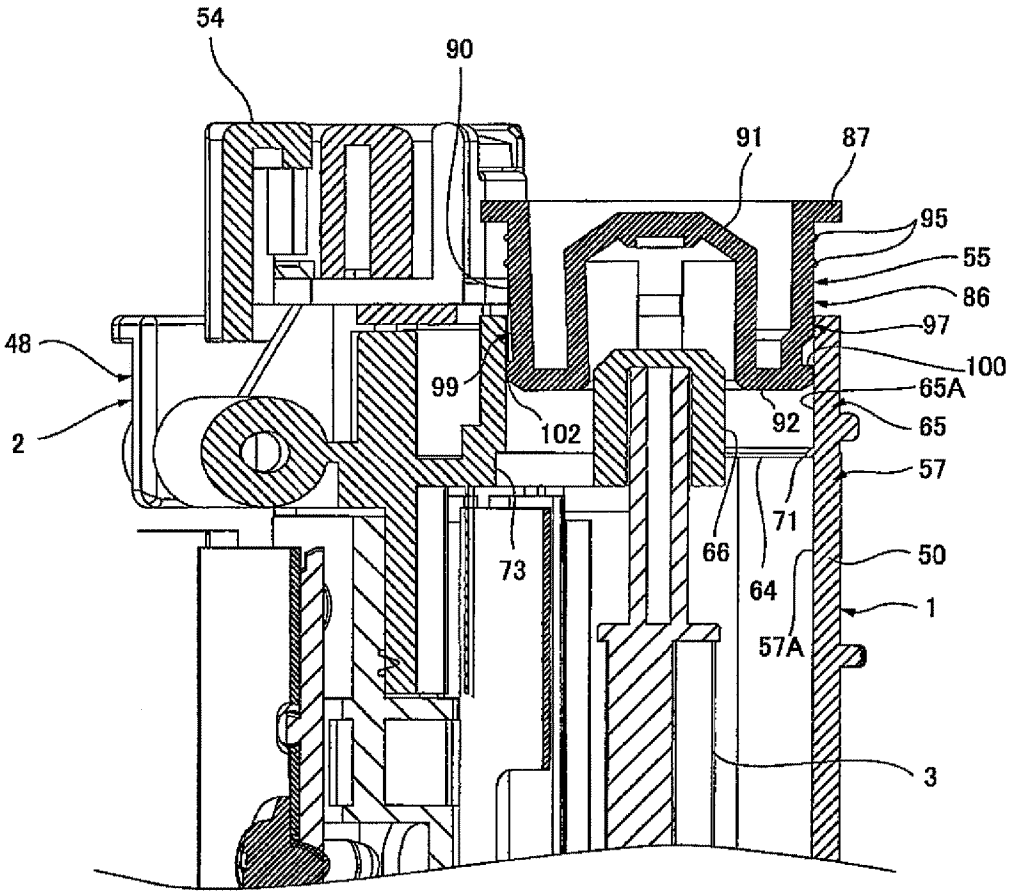
Fig. 9
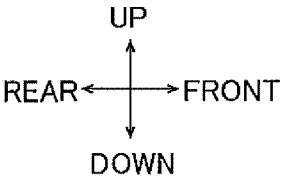

CARTRIDGE AND LID MEMBER FOR CARTRIDGE

CROSS REFERENCE TO RELATED APPLICATION

The present application claims priority from Japanese Patent Application No. 2013-227751 filed on Oct. 31, 2013, the disclosure of which is incorporated herein by reference in its entirety.

BACKGROUND

Field of the Invention

The present invention relates to a cartridge used in an image forming apparatus adopting an electro-photographic type, and a lid member for a cartridge.

Description of the Related Art

There is conventionally known a printer in an electro-photographic type to which a cartridge containing toner is removably installed.

As the cartridge installed to the printer, there is known a toner supply container including a toner container, which contains the toner therein and has a toner filling port, and a toner cap to be installed to the toner filling port.

In order to fix the toner cap to the toner filling port securely in the cartridge described in Japanese Patent Application Laid-open No. 2002-006607, the configuration in which the toner cap includes a claw and the toner supply container includes an engagement portion to be engaged with the claw of the toner cap is studied. In a case that the toner supply container is attempted to be downsized while the size of the toner filling port is maintained, there is problem that the downsizing of the toner supply container can not be achieved due to the engagement portion provided in the toner supply container.

SUMMARY

In view of the above, an object of the present teaching is to provide a cartridge which can be downsized or miniaturized, and of which lid member can be securely assembled to an inlet portion for filling a casing with a developer, and a lid member for a cartridge.

In order to achieve the above object, a cartridge of the present teaching includes a casing configured to contain a developer therein; an inlet portion which allows an inside of the casing to be communicated with an outside of the casing to fill the casing with the developer; a lid member which is installed to the inlet portion to close the inlet portion; and a first protruding portion which projects inward beyond an inner surface of the inlet portion in a direction perpendicular to an installation direction of the lid member. The lid member includes a recessed portion which is recessed from an outer surface of the lid member in the direction perpendicular to the installation direction and is configured to be engaged with the first protruding portion in a case that the lid member is installed to the inlet portion.

According to this structure, in the case that the lid member is installed to the inlet portion, the recessed portion of the lid member is engaged with the first protruding portion which projects inward beyond the inner surface of the inlet portion.

As described above, the first protruding portion is arranged to project inward beyond the inner surface of the inlet portion, and thus the lid member can be installed to the inlet portion reliably while the downsizing of the cartridge can be achieved.

In the case that the lid member is installed to the inlet portion, the occurrence of resistance between the lid member and the inlet portion can be prevented until a downstream end of the lid member in the installation direction is brought into contact with the first protruding portion.

As a result, the lid member can be installed to the inlet portion easily.

BRIEF DESCRIPTION OF THE DRAWINGS

FIG. 9 is still another cross-sectional view taken along the line A-A of FIG. 5A, which illustrates the assembly or installation of the toner cap.

DESCRIPTION OF THE EMBODIMENTS

<Outline of Developing Cartridge>

Figure 1:
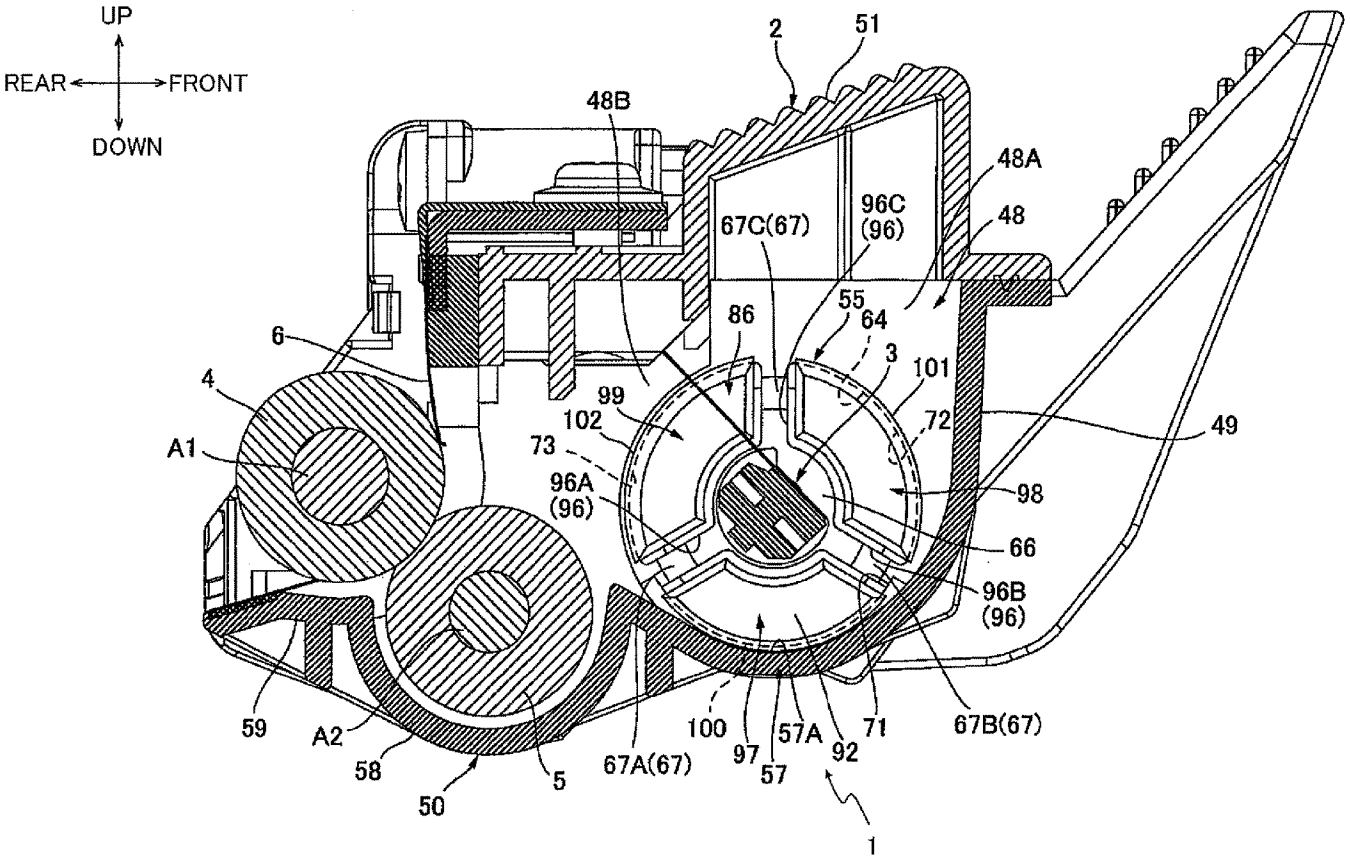
FIG. 1 is a central sectional view of a developing cartridge as an embodiment of a cartridge of the present teaching.

As depicted in FIG. 1, a developing cartridge 1 as an exemplary cartridge includes a developing frame 2 as an exemplary casing, an agitator 3, a supply roller 5, a developing roller 4, and a layer-thickness regulating blade 6.

In the following description, in a case that the direction concerning the developing cartridge 1 is mentioned, the direction in which the developing roller 4 is arranged is defined as the rear side of the developing cartridge 1, and the direction opposite to the direction in which the developing roller 4 is arranged is defined to as the front side of the developing cartridge 1. That is, when the sheet surface of FIG. 1 is placed in a landscape direction, the left side of FIG. 1 is defined as the rear side of the developing cartridge 1 and the right side of FIG. 1 is defined as the front side of the developing cartridge 1. Further, the upper side of FIG. 1 is defined as the upper side of the developing cartridge 1 and the lower side of FIG. 1 is defined as the lower side of the developing cartridge 1. Further, the left-right direction of the developing cartridge 1 is defined based on the direction when the developing cartridge 1 is viewed from the frontward position. That is, the near side of the sheet surface of FIG. 1 is defined as the left side of the developing cartridge 1 and the back or far side of the sheet surface of FIG. 1 is defined as the right side of the developing cartridge 1. Specifically, the respective directions are depicted by arrows in the drawings.

The developing frame 2 has a substantially boxed shape extending in the left-right direction, and the developing frame 2 contains toner as an exemplary developer. The rear end of the developing frame 2 is open in a front-rear direction.

The agitator 3 is arranged at the front part of the developing frame 2.

The supply roller 5 is arranged in the developing frame 2 on the lower-rear side of the agitator 3. The supply roller 5 is rotatably supported by the developing frame 2.

The developing roller 4 is arranged on the upper-rear side of the supply roller 5 at the rear end of the developing frame 2. The lower-front end of the developing roller 4 is brought in contact under pressure with the upper-rear end of the supply roller 5. Further, the upper part and the rear part of the developing roller 4 are exposed from the developing frame 2. The developing roller 4 is rotatably supported by the developing frame 2.

The layer-thickness regulating blade 6 is arranged on the upper-front side of the developing roller 4. The lower end of the layer-thickness regulating blade 6 makes contact with the front end of the developing roller 4.

<Overall Structure of Printer>

Figure 2:
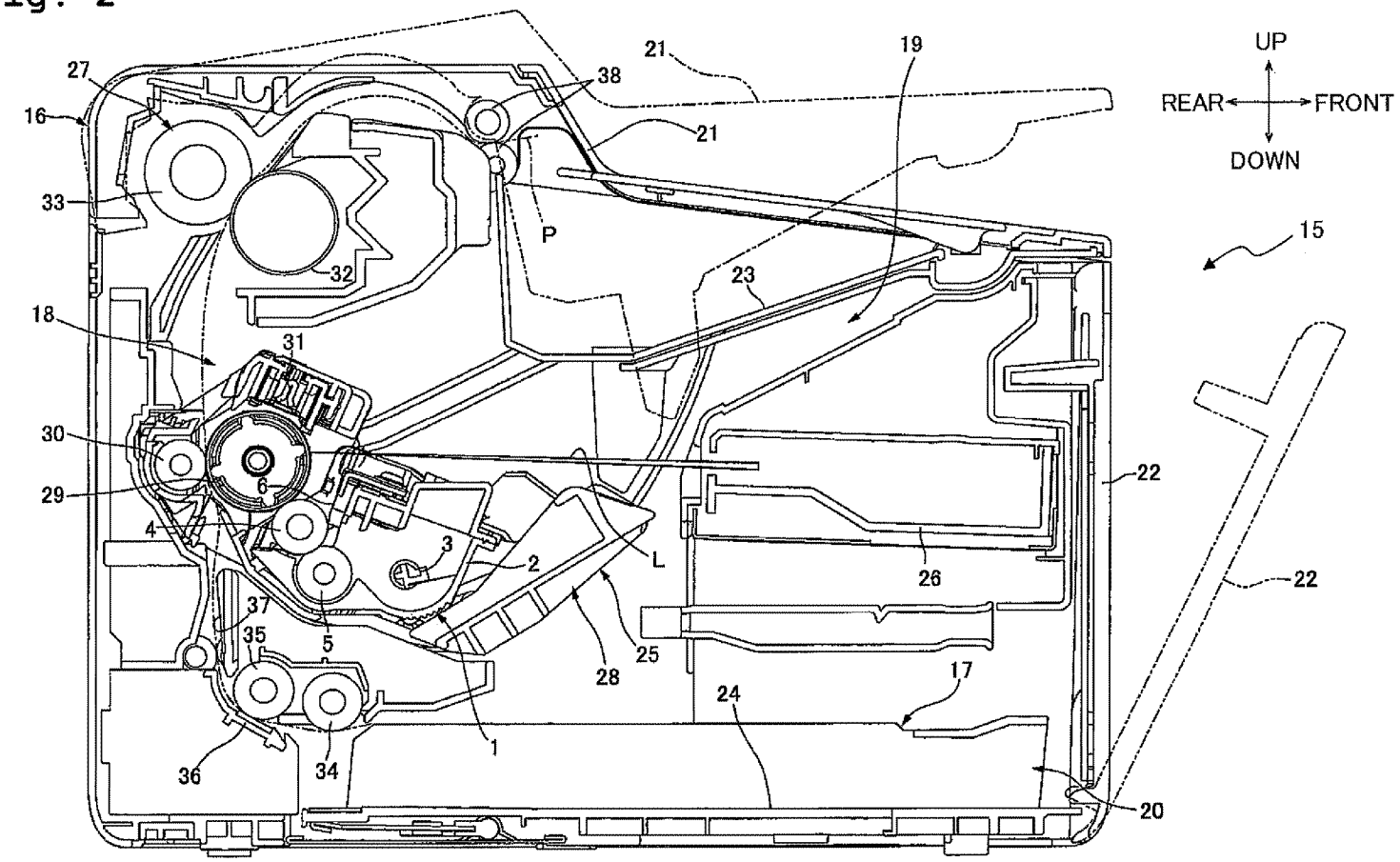
FIG. 2 is a central sectional view of a printer including the developing cartridge depicted in FIG. 1.

As depicted in FIG. 2, the developing cartridge 1 is installed to the printer 15.

The printer 15 is a monochrome printer in an electrophotographic type. The printer 15 includes a casing 16, a feed unit 17, and an image forming unit 18.

In a case that the direction concerning the printer 15 is mentioned, a state in which the printer 15 is placed in a horizontal direction is used as a reference, specifically, the arrows pointing the up-down direction and the front-rear direction depicted in FIG. 2 are used as a reference.

The casing 16 has a substantially boxed shape, and the casing 16 includes the feed unit 17 and the image forming unit 18. Further, the casing 16 includes a cartridge opening 19 and a sheet opening 20.

The cartridge opening 19 is arranged at the upper end of the casing 16, and the casing 16 is open in the up-down direction through the cartridge opening 19. The cartridge opening 19 has a shape and a size which allow a process cartridge 25 which will be described later to pass through the cartridge opening 19.

The sheet opening 20 is arranged at the lower part of the front end of the casing 16. The sheet opening 20 penetrates the front end of the casing 16 in a front-rear direction.

The casing 16 supports a top cover 21 and a feed cover 22.

The top cover 21 is arranged at the upper end of the casing 16 to cover the cartridge opening 19 therewith from the above. The top cover 21 includes a discharge tray 23. The discharge tray 23 is substantially U-shaped in side view to be formed as a recessed portion in which the front part of the top cover 21 is recessed downward. The upper-front side of the discharge tray 23 is open.

The top cover 21 is configured to be swingable between a closing position and an opening position with the rear end of the top cover 21 as the fulcrum, the closing position being a position where the cartridge opening 19 is closed, the opening position being a position where the cartridge opening 19 is open. In FIG. 2, the top cover 21 in the closing position is depicted by a solid line, and the top cover 21 positioned between the closing position and the opening position is depicted by alternate long and two short dashes lines.

The feed cover 22 is arranged at the front end of the casing 16 to cover the sheet opening 20 therewith from the front side.

The feed cover 22 is configured to be swingable between a closing position and an opening position with the lower end of the feed cover 22 as the fulcrum, the closing position being a position where the sheet opening 20 is closed, the opening position being a position where the sheet opening 20 is open. In FIG. 2, the feed cover 22 in the closing position is depicted by a solid line, and the feed cover 22 positioned between the closing position and the opening position is depicted by alternate long and two short dashes lines.

The feed unit 17 is configured to feed a sheet P to the image forming unit 18. The feed unit 17 is arranged at the bottom of the casing 16. The feed unit 17 includes a sheet placement portion 24.

The sheet placement portion 24 is arranged at the lower end of the casing 16.

The image forming unit 18 is arranged in the casing 16 above the feed unit 17.

The image forming unit 18 includes the process cartridge 25, a scanner unit 26, and a fixing unit 27.

The process cartridge 25 is configured to be installed to or removed from the casing 16 via the cartridge opening 19 in a state that the top cover 21 is arranged at the opening position. The process cartridge 25 in a stated of being installed to the casing 16 is arranged above the rear part of the feed unit 17.

The process cartridge 25 includes a drum cartridge 28 and the developing cartridge 1.

The drum cartridge 28 includes a photosensitive drum 29, a transfer roller 30, and a scorotron charger 31.

The photosensitive drum 29 is arranged at the rear part of the drum cartridge 28 and is configured to be rotatable.

The transfer roller 30 is arranged on the rear side of the photosensitive drum 29, and is configured to be rotatable. The front end of the transfer roller 30 is brought in contact under pressure with the rear end of the photosensitive drum 29.

The scorotron charger 31 is arranged on the upper-front side of the photosensitive drum 29 with a spacing distance intervening therebetween.

The developing cartridge 1 is configured to be installed to or remove from the drum cartridge 28. Accordingly, the developing cartridge 1 is configured to be installed to or remove from the casing 16.

The developing cartridge 1 in a state of being installed to the drum cartridge 28 is arranged on the lower-front side of the photosensitive drum 29. The rear-upper end of the developing roller 4 of the developing cartridge 1 is brought in contact with the lower-front end of the photosensitive drum 29.

The scanner unit 26 is arranged in the casing 16 at the front side of the process cartridge 25. A laser beam L based on image data is emitted from the scanner unit 26 to the photosensitive drum 29 to expose the circumferential surface of the photosensitive drum 29. That is, the scanner unit 26 is configured to emit the laser beam L to the photosensitive drum 29. Then, the laser beam L is scanned on the photosensitive drum 29 while being allowed to repeat blink so as to form an electrostatic latent image based on the image data on the photosensitive drum 29.

The fixing unit 27 is arranged in the casing 16 above the rear part of the process cartridge 25. The fixing unit 27 includes a heating roller 32 and a pressurizing roller 33. The pressurizing roller 33 is arranged on the upper-rear side of the heating roller 32. The lower-front end of the pressurizing roller 33 is brought in contact under pressure with the upper-rear end of the heating roller 32.

In the printer 15, at first, an operator arranges the feed cover 22 at the opening position to open the sheet opening 20. Then, the rear part of the sheet P is introduced into the casing 16 via the sheet opening 20.

Accordingly, the rear parts of the sheets P are stacked on the upper surface of the sheet placement portion 24 in the casing 16 and the front parts of the sheets P are stacked on the upper surface of the sheet cover 22 outside the casing 16.

Subsequently, when an image forming operation is started by the control of an unillustrated controller, the surface of the photosensitive drum 29 is uniformly charged by the scorotron charger 31. Then, the surface of the photosensitive drum 29 is exposed by the scanner unit 26. Accordingly, the electrostatic latent image based on the image data is formed on the surface of the photosensitive drum 29.

The agitator 3 of the developing cartridge 1 agitates the toner in the developing frame 2 and supplies the agitated toner to the supply roller 5. The supply roller 5 conveys the supplied toner to the developing roller 4 to supply the toner to the developing roller 4. In this situation, the toner is frictionally charged between the developing roller 4 and the supply roller 5 and the toner is carried on the circumferential surface of the developing roller 4. The layer-thickness regulating blade 6 regulates the toner carried on the circumferential surface of the developing roller 4 to have a certain thickness.

Then, the toner carried on the developing roller 4 is supplied to the electrostatic latent image on the surface of the photosensitive drum 29 by the developing roller 4. Accordingly, the toner image is carried on the surface of the photosensitive drum 29.

The rotation of a pickup roller 34 sends each of the sheets P stacked on the sheet placement portion 24 between a feed roller 35 and a feed pad 36. The rotation of the feed roller 35 disentangles or unravels the sheets P sent between the feed roller 35 and the feed pad 36 one by one. Then, the rotation of the feed roller 35 allows each sheet P to be conveyed to a feed path 37 extending in the up-down direction at a predetermined timing, so that each sheet P is fed between the photosensitive drum 29 and the transfer roller 30.

Subsequently, when the sheet P is passed between the photosensitive drum 29 and the transfer roller 30, the transfer roller 30 transfers the toner image on the photosensitive drum 29 to the sheet P by transfer bias.

After the transfer, the sheet P is conveyed between the heating roller 32 and the pressurizing roller 33. The heating roller 32 heats the sheet P and the pressurizing roller 33 pressurizes the sheet P when the sheet P is passed between the heating roller 32 and the pressurizing roller 33. In this situation, the toner image on the sheet P is thermally fixed on the sheet P. Thereafter, the sheet P is conveyed between a pair of discharge rollers 38, and the sheet P is discharged on the discharge tray 23 of the top cover 21 by the pair of discharge rollers 38.

As described above, the sheet P is fed from the sheet placement portion 24 and is allowed to pass between the photosensitive drum 29 and the transfer roller 30. Then, the sheet P is allowed to pass between the heating roller 32 and the pressurizing roller 33, and further the sheet P is conveyed through the conveyance path having a substantially C-shape form in side view, so that the sheet P is discharged on the discharge tray 23.

<Details of Developing Cartridge>

<Developing Frame>

Figure 3:
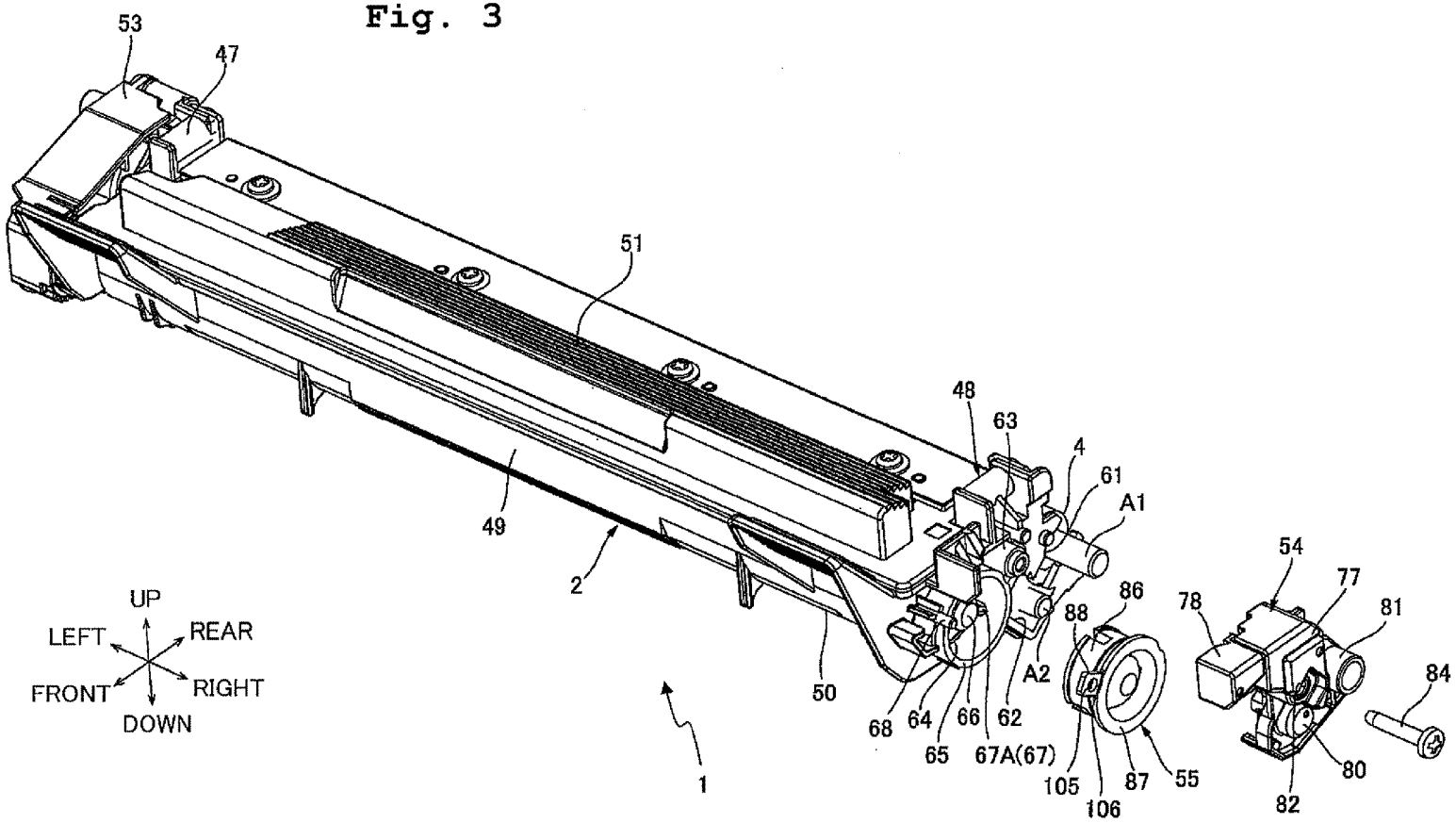
FIG. 3 is an exploded perspective view of the developing cartridge depicted in FIG. 1 as viewed from a right upward position.

As depicted in FIGS. 1 and 3, the developing frame 2 includes a left side wall 47, a right side wall 48, a front wall 49, a lower wall 50, and an upper wall 51.

The left side wall 47 is arranged at the left end of the developing frame 2. The left side wall 47 has a plate shape which extends in the front-rear direction and is substantially rectangular in side view. In the left surface of the left side wall 47, there are arranged the developing roller 4, the supply roller 5, an unillustrated gear train for driving the agitator 3, and a gear cover 53 for covering the gear train.

The right side wall 48 is arranged at the right end of the developing frame 2 to face the left side wall 47 with a space provided therebetween. Similar to the left side wall 47, the right side wall 48 has a plate shape which is substantially rectangular in side view. As will be discussed in greater detail below, a toner cap 55 and an electrode member 54 for supplying electricity to the developing roller 4 and the supply roller 5 are assembled on the surface of the right side wall 48 positioned outside in the left-right direction.

The front wall 49 is arranged at the front end of the developing frame 2 to span between the front end of the left side wall 47 and the front end of the right side wall 48. The front wall 49 is a plate-shaped member which extends in the left-right direction and is substantially rectangular in front view.

The lower wall 50 is arranged at the lower end of the developing frame 2 to span between the lower end of the left side wall 47 and the lower end of the right side wall 48. The lower wall 50 includes a curved portion 57, a circular-arc portion 58, and a lip portion 59, those of which are integrally formed.

Figure 4:
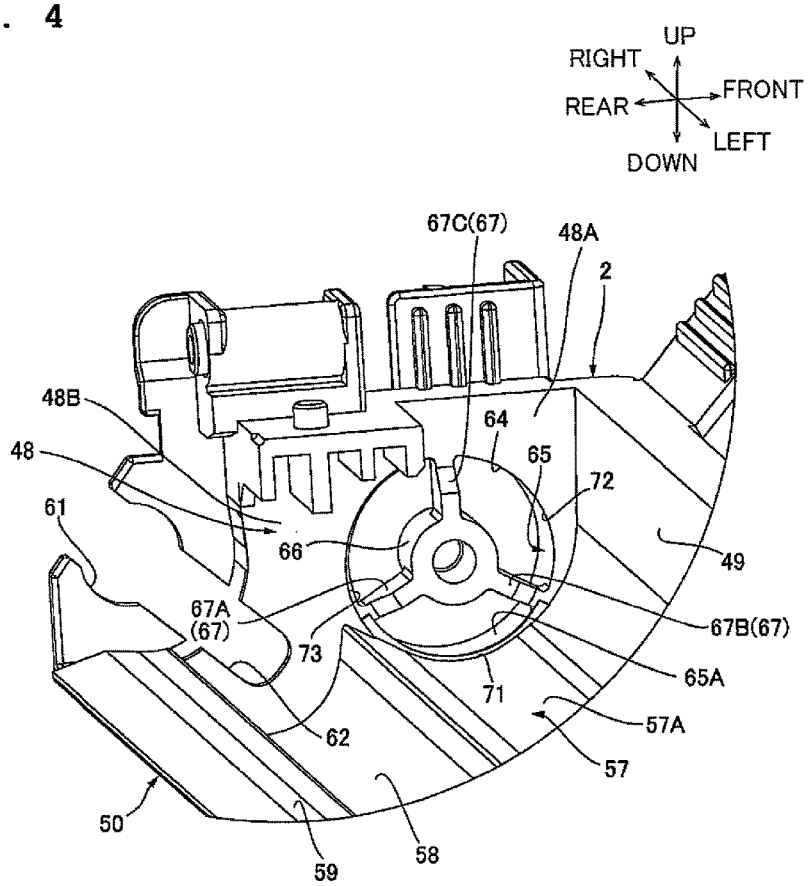
FIG. 4 is a perspective view illustrating main components of a right side wall of the developing cartridge depicted in FIG. 1 as viewed from a left rearward position.

The curved portion 57 is the front part of the lower wall 50. The curved portion 57 extends rearward continuously from the lower end of the front wall 49 while curving downward. As depicted in FIG. 1 and FIG. 4, an approximately center portion of the inner circumferential surface of the curved portion 57 in the front-rear direction has a substantially circular-arc shape which is concentric with the rotational shaft of the agitator 3. The upper surface of the approximately center portion of the curved portion 57 in the front-rear direction is referred to as a center upper-surface of curved portion 57A.

The circular-arc portion 58 is arranged adjacent to the rear part of the curved portion 57. The circular-arc portion 58 has a substantially semicircular-arc shape in side view, the upper side of which is open. The inner circumferential surface of the circular-arc portion 58 extends along the circumferential surface of the supply roller 5. The front end of the circular-arc portion 58 is connected to the rear end of the curved portion 57.

The lip portion 59 is arranged adjacent to the rear part of the circular-arc portion 58. The lip portion 59 extends rearward continuously from the rear end of the circular-arc portion 58.

As depicted in FIGS. 1 and 3, the upper wall 51 has a substantially boxed shape extending in the left-right direction, the lower side of which is open. The upper wall 51 is arranged above the left side wall 47, the right side wall 48, and the front wall 49. The periphery of the upper wall 51 is fixed to the upper end of the left side wall 47, the upper end of the right side wall 48, and the upper end of the front wall 49 by a method such as welding or adhesion.

<Right Side Wall>

As depicted in FIGS. 3 and 4, the right side wall 48 includes a developing roller bearing hole 61 and a supply roller bearing hole 62.

The developing roller bearing hole 61 has a substantially circular shape in side view and penetrates the right side wall 48 almost in the center of the rear end of the right side wall 48 in the up-down direction. The upper rear side of the developing roller bearing hole 61 is open. The developing roller bearing hole 61 rotatably supports the rotational shaft of the developing roller 4. In the following description, the rotational shaft of the developing roller 4 is referred to as a developing roller shaft A1.

The supply roller bearing hole 62 is arranged at the lower end of the right side wall 48 on the lower-front side of the developing roller bearing hole 61. The supply roller bearing hole 62 has a substantially rectangular shape in side view and penetrates the right side wall 48. Further, the upper-rear end of the supply roller bearing hole 62 is communicated with the lower-front end of the developing roller bearing hole 61. The supply roller bearing hole 62 rotatably supports the rotational shaft of the supply roller 5. In the following description, the rotational shaft of the supply roller 5 is referred to as a supply roller shaft A2.

The right side wall 48 includes a screw portion 63, a toner filling port 64, a cylindrical portion 65 which is an exemplary inlet portion, a support portion 66, a connection portion 67, and an insertion portion 68.

As depicted in FIG. 3, the screw portion 63 is arranged on the front side of the developing roller bearing hole 61 and the upper side of the supply roller bearing hole 62. The screw portion 63 has a substantially cylindrical shape which projects rightward from the right surface of the right side wall 48. The inner circumferential surface of the screw portion 63 includes a thread.

The toner filling port 64 has a substantially circular shape in side view, and penetrates the right side wall 48 to communicate with the inside of the developing frame 2. A part of the toner filling port 64, at an area of the rear half of the right side wall 48, is located at the rear side of the supply roller bearing hole 62. The lower end of the toner filling port 64 almost in the center of the front-rear direction is coincident with the center upper-surface of curved portion 57A of the lower wall 50, in side view. As depicted in FIG. 1, there is a difference in level in the left-right direction in the inner surface of the right side wall 48 so that the periphery of the toner filling port 64 is a boundary. Specifically, the periphery of the toner filling port 64 and the portion which is positioned on the front side of the approximately center portion of the toner filling port 64 in the front-rear direction are referred to as a front portion 48A, and the portion, other than the periphery of the toner filling port 64, positioned on the rear side of the approximately center portion of the toner filling port 64 in the front-rear direction is referred to as a rear portion 48B. The front portion 48A is arranged outside the rear portion 48B in the left-right direction.

Figure 6:
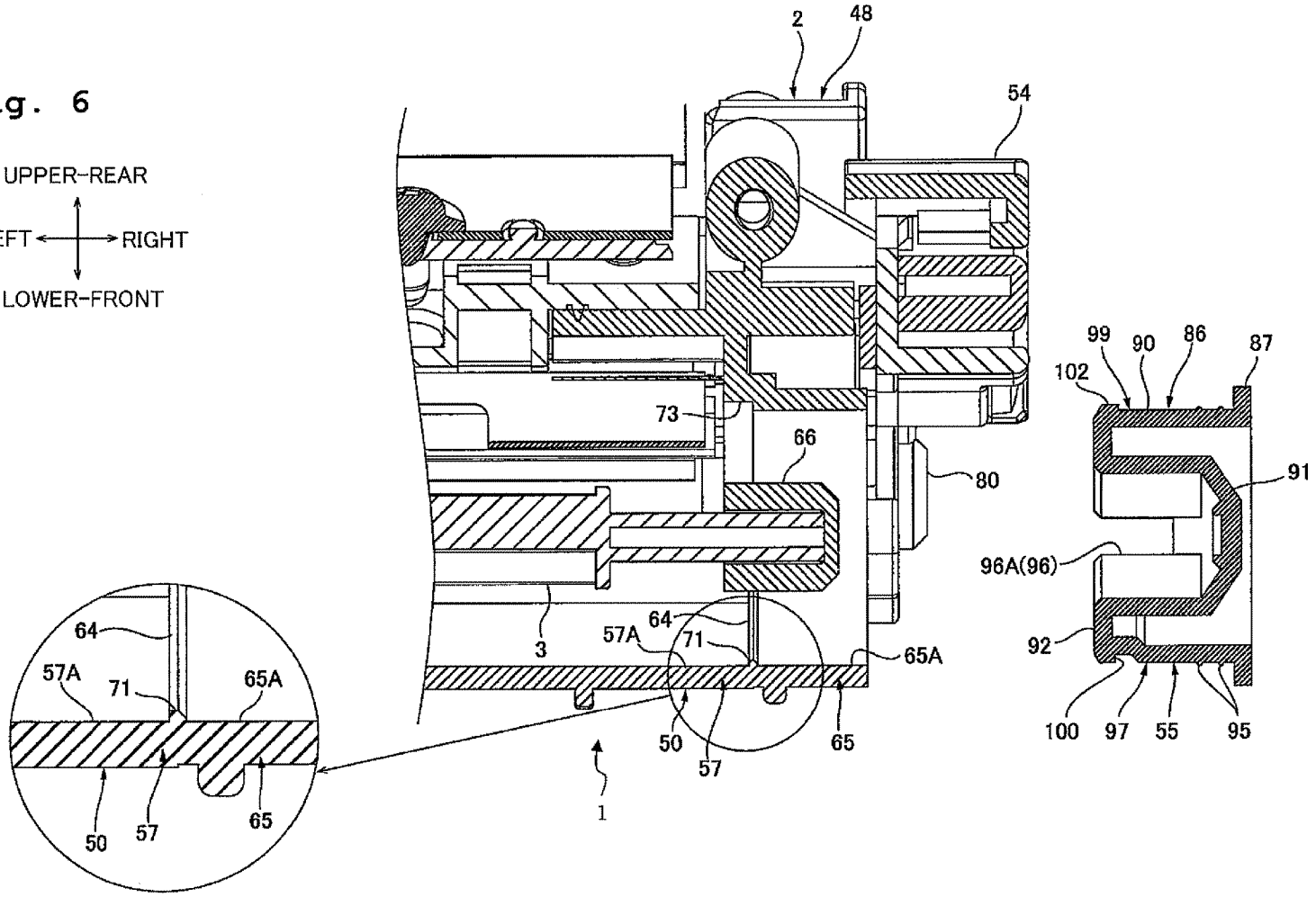
FIG. 6 is a cross-sectional view taken along the line A-A of FIG. 5A, which depicts a state that the toner cap is removed from the developing cartridge.

As depicted in FIGS. 3 and 4, the cylindrical portion 65 has a substantially cylindrical shape which projects rightward from the periphery of the toner filling port 64. The inner diameter of the cylindrical portion 65 is the same as the diameter of the toner filling port 64. The lower end of inner circumference of the cylindrical portion 65 almost in the center of the front-rear direction is referred to as a center inner-surface of cylindrical portion 65A. The inner surface of the toner filling port 64 is flush with the inner surface of the cylindrical portion 65. That is, the center inner-surface of cylindrical portion 65A is coincident with the center upper-surface of curved portion 57A of the lower wall 50 in side view. In other words, the lower end of the cylindrical portion 65 almost in the center of the front-rear direction is connected to the right end of the lower wall 50. As depicted in FIG. 6, the thickness of the cylindrical portion 65 is slightly thinner than the thickness of the lower wall 50 to which the cylindrical portion 65 is connected.

As depicted in FIGS. 3 and 4, the support portion 66 is arranged at an approximately center, in a radial direction, of the toner filling port 64 and the cylindrical portion 65. As depicted in FIG. 6, the support portion 66 has a substantially cylindrical shape of which right end is closed. The periphery of the right end surface of the support portion 66 is inclined inward of the support portion 66 in the radial direction toward the right side in the left-right direction. The support portion 66 rotatably supports the right end of the rotational shaft of the agitator 3.

Figure 5A:
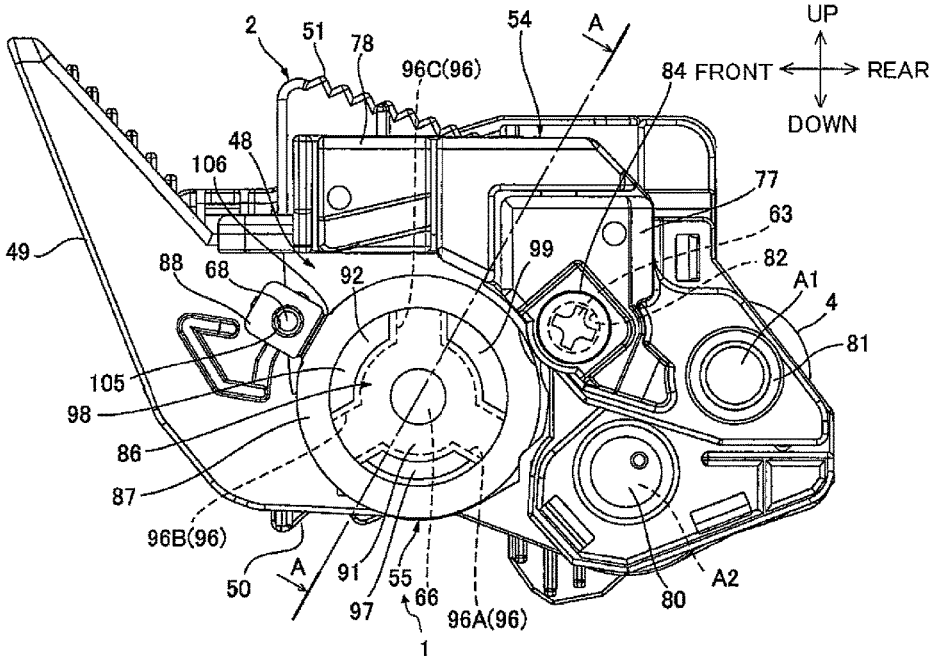
FIG. 5A is a right-side view of the developing cartridge depicted in FIG. 1.
Figure 5B:
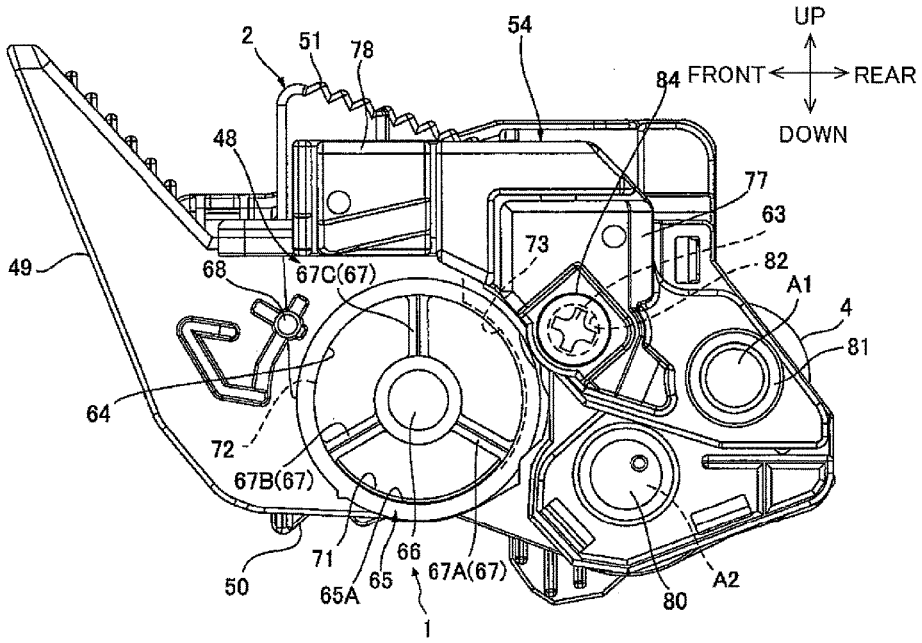
FIG. 5B is a right-side view of the developing cartridge depicted in FIG. 1 of which toner cap is removed.

As depicted in FIG. 4 and FIG. 5B, the connection portion 67 has a substantially rod or bar shape as follows. That is, the connection portion 67 extends from the outer circumferential surface of the support portion 66 to the right side wall 48 (in other words, the connection portion 67 extends outward of the support portion 66 in the radial direction), and the connection portion 67 is connected to the inner circumferential surfaces of the toner filling port 64 and the cylindrical portion 65. Further, the connection portion 67 has a substantially triangular-shaped cross section having a width tapering off from the left side to the right side. Three connection portions 67 are arranged at regular intervals to be displaced by 120 degrees from each other in the circumferential direction of the toner filling port 64. More specifically, the three connection portions 67 are a first connection portion 67 extending from the support portion 66 in the lower-rear direction, a second connection portion 67B extending from the support portion 66 in the lower-front direction, and a third connection portion 67C extending upward from the support portion 66, in the toner filling port 64 and the cylindrical portion 65.

As depicted in FIG. 3 and FIG. 5B, the insertion portion 68 is arranged on the upper-front side of the cylindrical portion 65. The insertion portion 68 has a substantially cylindrical shape which projects rightward from the right surface of the right side wall 48.

As depicted in FIG. 4, the right side wall 48 includes a frame protruding portion 71 as an exemplary first protruding portion, a corner 72 as an exemplary engagement portion, and a multilevel portion 73 as another exemplary engagement portion.

As depicted in FIG. 4 and FIG. 5B, the frame protruding portion 71 projects inward of the cylindrical portion 65 in the radial direction from the lower part of the left end of the inner circumferential surface of the cylindrical portion 65. Specifically, the frame protruding portion 71 is arranged in an area, in the inner circumference of the cylindrical portion 65, between the first connection portion 67A and the second connection portion 67B when projected in the left-right direction. That is, the frame protruding portion 71 is arranged in an approximately 120-degree range in the inner circumference of the cylindrical portion 65 when projected in the left-right direction.

As depicted in FIG. 6, the frame protruding portion 71 includes a substantially ridged portion which projects inward of the cylindrical portion 65 in the radial direction from the inner circumferential surface of the cylindrical portion 65. The right surface of the frame protruding portion 71 is inclined inward of the cylindrical portion 65 in the radial direction toward the left side in the left-right direction.

As depicted in FIG. 4 and FIG. 5B, the corner 72 is an upper-front part of the left end of the inner circumferential surface of the cylindrical portion 65. Specifically, the corner 72 is arranged in an area, in the inner circumference of the cylindrical portion 65, between the second connection portion 67B and the third connection portion 67C when projected in the left-right direction. That is, the corner 72 is arranged in an approximately 120-degree range in the inner circumference of the cylindrical portion 65 when projected in the left-right direction.

As depicted in FIG. 4, the corner 72 is a portion at which the left end of the cylindrical portion 65 is continued to the inner surface of the right side wall 48. In other words, the corner 72 is defined by the connection portion between the cylindrical portion 65 and the right side wall 48.

As depicted in FIG. 4 and FIG. 5B, the multilevel portion 73 is an upper-rear part of the left end of the inner circumferential surface of the cylindrical portion 65. Specifically, the multilevel portion 73 is arranged in an area, in the inner circumference of the cylindrical portion 65, between the first connection portion 67A and the third connection portion 67C when projected in the left-right direction. That is, the multilevel portion 73 is arranged in an approximately 120-degree range in the inner circumference of the cylindrical portion 65 when projected in the left-right direction.

As depicted in FIG. 4 and FIG. 6, the multilevel portion 73 is a stepped portion which is defined as follows. That is, the left end of the cylindrical portion 65 is continued to the inner surface of the right side wall 48, and the positions of the front portion 48A and the rear portion 48B of the right side wall 48 in the left-right direction are allowed to mutually deviate to have difference in level at the periphery of the toner filling port 64. In other words, the multilevel portion 73 is depressed or recessed outward of the cylindrical portion 65 in the radial direction beyond the inner surface of the cylindrical portion 65.

The area, in the inner surface of the cylindrical portion 65, where the frame protruding portion 71 is arranged is smaller than the sum of the area where the corner 72 is arranged and the area where the multilevel portion 73 is arranged, as the developing frame 2 is viewed in the left-right direction.

As depicted in FIG. 3, the electrode member 54 as an exemplary functional component is assembled to the right surface of the right side wall 48, and the toner cap 55 as an exemplary lid member is assembled to the cylindrical portion 65 of the right side wall 48.

<Electrode Member>

As depicted in FIG. 3 and FIG. 5B, the electrode member 54 as the exemplary functional component is assembled to the right surface of the right side wall 48.

The electrode member 54 is configured as follows. That is, in a case that electricity is supplied from an unillustrated power source of the casing 16, the electrode member 54 applies developing bias to the developing roller 4 and applies supply bias to the supply roller 5.

The electrode member 54 is thick-plate shaped to have a thickness in the left-right direction. The electrode member 54 is substantially L-shaped in side view. Specifically, the electrode member 54 includes a first portion 77 and a second portion 78, the first portion 77 overlapping with a portion of the right side wall 48 positioned on the rear side of the cylindrical portion 65 when projected in the left-right direction, the second portion 78 overlapping with a portion of the right side wall 48 positioned on the upper side of the cylindrical portion 65 when projected in the left-right direction.

The first portion 77 has a substantially rectangular shape in side view in which the first portion 77 extends in the up-down direction and the lower end thereof swells out rearward.

The second portion 78 has a substantially rectangular shape in side view to extend frontward continuously from the upper-front end of the first portion 77.

The electrode member 54 includes a supply roller shaft receiving portion 80, a developing roller shaft covering portion 81, and an engagement hole 82.

The supply roller shaft receiving portion 80 is arranged at the lower-front end of the first portion 77. The supply roller shaft receiving portion 80 has a substantially cylindrical shape in which the supply roller shaft receiving portion 80 extends rightward from the first portion 77 and the right end thereof is closed. The inner diameter of the supply roller shaft receiving portion 80 is substantially the same as the diameter of the supply roller shaft A2.

The developing roller shaft covering portion 81 is arranged at the rear part of the first portion 77 on the upper-rear side of the supply roller shaft receiving portion 80. The developing roller shaft covering portion 81 has a substantially cylindrical shape to extend rightward from the first portion 77. The inner diameter of the developing roller shaft covering portion 81 is substantially the same as the diameter of the developing roller shaft A1.

The engagement hole 82 is arranged at the upper-front end of the first portion 77 on the upper side of the supply roller shaft receiving portion 80 and the front side of the developing roller shaft covering portion 81. The engagement hole 82 has a substantially circular shape in side view to penetrate the first portion 77. The inner diameter of the engagement hole 82 is substantially the same as the outer diameter of the screw portion 63.

The electrode member 54 is assembled to the right side wall 48 such that the supply roller shaft A2 is received by the supply roller shaft receiving portion 80, the supply roller shaft A2 is received by the developing roller shaft covering portion 81, and the screw portion 63 is received by the engagement hole 82. Further, the electrode member 54 is fixed to the right side wall 48 by screwing a screw member 84 to the screw portion 63. That is, the electrode member 54 is arranged adjacent to the cylindrical portion 65 in side view.

<Toner Cap>

As depicted in FIG. 3 and FIG. 5A, the toner cap 55 as an exemplary lid member is assembled to the cylindrical portion 65 of the right side wall 48.

The toner cap 55 is made of a material having elasticity such as resin. As depicted in FIG. 6 to FIG. 7D, the toner cap 55 includes a main body 86, a flange 87, and a fixed portion 88.

In a case that the direction concerning the toner cap 55 is mentioned, a state in which the toner cap 55 is assembled to the cylindrical portion 65 of the right side wall 48 is used as a reference. Specifically, the arrow directions depicted in FIG. 6 to FIG. 7D are used as a reference.

The main body 86 is configured to close the toner filling port 64 by being engaged with the cylindrical portion 65 to face the toner filling port 64. The main body 86 includes an outer cylinder 90, an inner cylinder 91, and an end wall 92.

The outer cylinder 90 has a substantially cylindrical shape to extend in the left-right direction. The outer cylinder 90 includes a plurality of rings 95, that is, two rings 95.

The two rings 95 are configured to improve the sealing property of the toner cap 55 with respect to the toner filling port 64 when the toner cap 55 is assembled to the cylindrical portion 65. Each of the rings 95 has a substantially annular shape to project outward in the radial direction from the outer circumferential surface of the right part of the outer cylinder 90. The two rings 95 are arranged to have a space in the left-right direction.

The inner cylinder 91 is arranged inside the outer cylinder 90 in the radial direction. The inner cylinder 91 has a substantially cylindrical shape of which right end is closed. The inner diameter of the inner cylinder 91 is larger than the outer diameter of the support portion 66. The size of the inner cylinder 91 in the left-right direction is longer than the size of the support portion 66 in the left-right direction and is shorter than the size of the outer cylinder 90 in the left-right direction. The left end of the inner cylinder 91 overlaps with the left end of the outer cylinder 90 when the inner cylinder 91 is projected in a direction perpendicular to the left-right direction.

The end wall 92 is arranged at the left end of the main body 86. The end wall 92 is provided to span between the left end of the outer cylinder 90 and the left end of the inner cylinder 91. The end wall 92 is substantially annular plate shaped in side view. Further, the end wall 92 is on the same plane in a direction perpendicular to the installation direction at the left end of the main body 86.

The main body 86 includes a plurality of notched grooves 96, that is, three notched grooves 96.

Each of the notched grooves 96 is defined in the main body 86 by recessing an area, in the main body 86, ranging from the left end thereof to the approximately center in the left-right direction. The inside of the inner cylinder 91 in the radial direction is communicated with the outside of the outer cylinder 90 in the radial direction by the notched groove 96. In other words, the notched groove 96 is a groove which is defined by cutting an area, in the main body 86, ranging from the downstream end in the installation direction of the toner cap 55 to the upstream side in the installation direction to form a recessed portion. More specifically, the three notched grooves 96 are a first notched groove 96A arranged at the lower-rear part of the main body 86, a second notched groove 96B arranged at the lower-front part of the main body 86, and a third notched groove 96C arranged at the upper part of the main body 86.

The main body 86 includes a first bending portion 97, a second bending portion 98, and a third bending portion 99.

The first bending portion 97 is arranged at a lower part of the left end of the main body 86. The first bending portion 97 is defined between the first notched groove 96A and the second notched groove 96B in the circumferential direction of the main body 86. That is, the first bending portion 97 has a substantially circular-arc shape in side view and a substantially boxed shape with the left end closed. The first bending portion 97 includes a recessed portion 100.

The recessed portion 100 is a groove which is defined by recessing an area, in the first bending portion 97, ranging from the outer periphery on the immediate right side of the left end thereof to the inward thereof in the radial direction, over the entire area of the first bending portion 97 in the circumferential direction.

The second bending portion 98 is arranged at the upper-front part of the left end of the main body 86. The second bending portion 98 is defined between the second notched groove 96B and the third notched groove 96C in the circumferential direction of the main body 86. That is, the second bending portion 98 has a substantially circular-arc shape in side view and a substantially boxed shape with the left end closed. The second bending portion 98 includes a first locking portion 101 as an exemplary second protruding portion.

The first locking portion 101 includes a substantially ridged portion which projects outward in the radial direction from the outer circumferential surface of the left end of the second bending portion 98 over the entire area of the second bending portion 98 in the circumferential direction. The periphery of the left end of the first locking portion 101 is chamfered. The first locking portion 101 and the recessed portion 100 of the first bending portion 97 are arranged to mutually deviate in the left-right direction.

The third bending portion 99 is arranged at the upper-rear part of the left end of the main body 86. The third bending portion 99 is defined between the first notched groove 96A and the third notched groove 96C in the circumferential direction of the main body 86. That is, the third bending portion 99 has a substantially circular-arc shape in side view and a substantially boxed shape with the left end closed. The third bending portion 99 includes a second locking portion 102 as an exemplary second protruding portion.

The second locking portion 102 includes a substantially ridged portion which projects outward in the radial direction from the outer circumferential surface of the left end of the third bending portion 99 over the entire area of the third bending portion 99 in the circumferential direction. The periphery of the left end of the second locking portion 102 is chamfered. The second locking portion 102 and the recessed portion 100 of the first bending portion 97 are arranged to mutually deviate in the left-right direction, and the second locking portion 102 and the first locking portion 101 of the second bending portion 98 are arranged at the same position in the left-right direction.

The first bending portion 97, the second bending portion 98, and the third bending portion 99 are arranged at regular intervals to be displaced by 120 degrees from each other in the circumferential direction of the main body 86. That is, in the main body 86, the recessed portion 100, the first locking portion 101, and the second locking portion 102 are arranged at regular intervals to be displaced by 120 degrees from each other in the circumferential direction of the main body 86. Further, as the toner cap 55 is viewed from the left-right direction, the center of the main body 86 is referred to as a main body center C1, and the center of an insertion hole 105 of the fixed portion 88 which will be described later is referred to as a fixed portion center C2. Here, as the toner cap 55 is viewed from the left-right direction, the recessed portion 100, the first locking portion 101, and the second locking portion 102 are arranged non-linear symmetrically, with respect to a virtual line X which passes through the main body center C1 and the fixed portion center C2 to divide the toner cap 55 into two pieces.

The flange 87 is arranged at the right end of the toner cap 55. The flange 87 has a substantially annular shape to project outward in the radial direction from the outer periphery of the right end of the outer cylinder 90 of the main body 86. The outer diameter of the flange 87 is substantially the same as the outer diameter of the cylindrical portion 65.

The fixed portion 88 projects toward the upper-front side of the flange 87 from a part of the outer peripheral surface of the flange 87, that is, the fixed portion 88 projects outward of the flange 87 in the circumferential direction. Specifically, the fixed portion 88 is arranged between the second notched groove 96B and the third notched groove 96C in the circumferential direction of the flange 87, the second notched groove 96B being adjacent to the third notched groove 96C. The fixed portion 88 is substantially rectangular plate-shaped in side view. The fixed portion 88 includes the insertion hole 105 and a thin portion 106.

The insertion hole 105 has a substantially circular shape in side view and penetrates the fixed portion 88. The inner diameter of the insertion hole 105 is substantially the same as the diameter of the insertion portion 68.

The thin portion 106 is arranged at a base end of the fixed portion 88, that is, a boundary of the fixed portion 88 with the flange 87. The thickness of plate of the thin portion 106 is formed to be thin by forming the notch in a surface and a rear surface of the fixed portion 88 in the direction perpendicular to the extending direction of the fixed portion 88.

<Filling of Toner>

Figure 8:
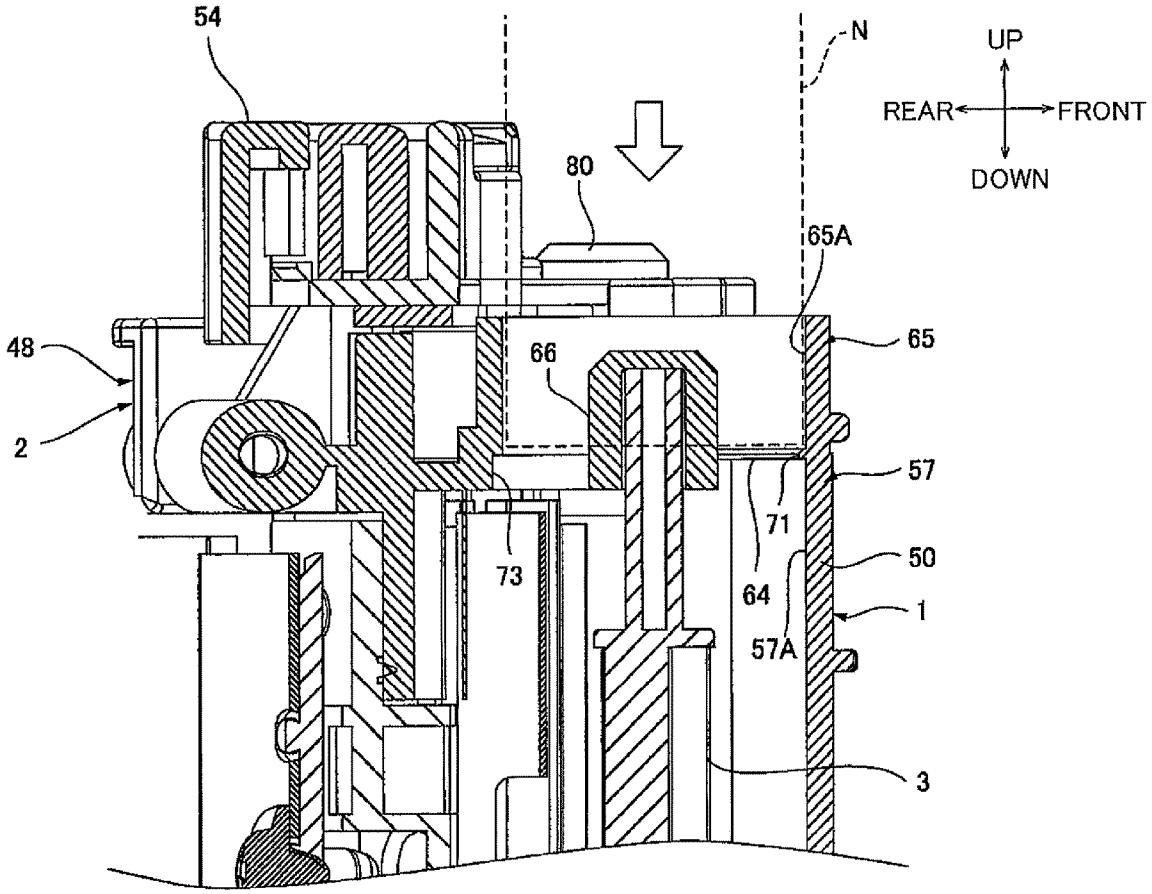
FIG. 8 is another cross-sectional view taken along the line A-A of FIG. 5A, which illustrates the filling of toner into a developing frame.

As depicted in FIG. 8, the developing frame 2 of the developing cartridge 1 is filled with the toner before shipment and transportation of the developing cartridge 1 as a product.

In order to perform the filling of toner, at first, the operator arranges the developing cartridge 1 from which the toner cap 55 is removed so that the right end of the developing cartridge 1 is positioned on the upper side to make the cylindrical portion 65 face upward.

Then, the operator inserts a filling nozzle N in the cylinder portion 65 to fill the developing frame 2 with the toner via the cylindrical portion 65 and the toner filling port 64.

<Assembly or Installation of Toner Cap>

After the developing frame 2 is filled with the toner, the toner cap 55 is assembled or installed to the cylindrical portion 65 to close the toner filling port 64.

Figure 10:
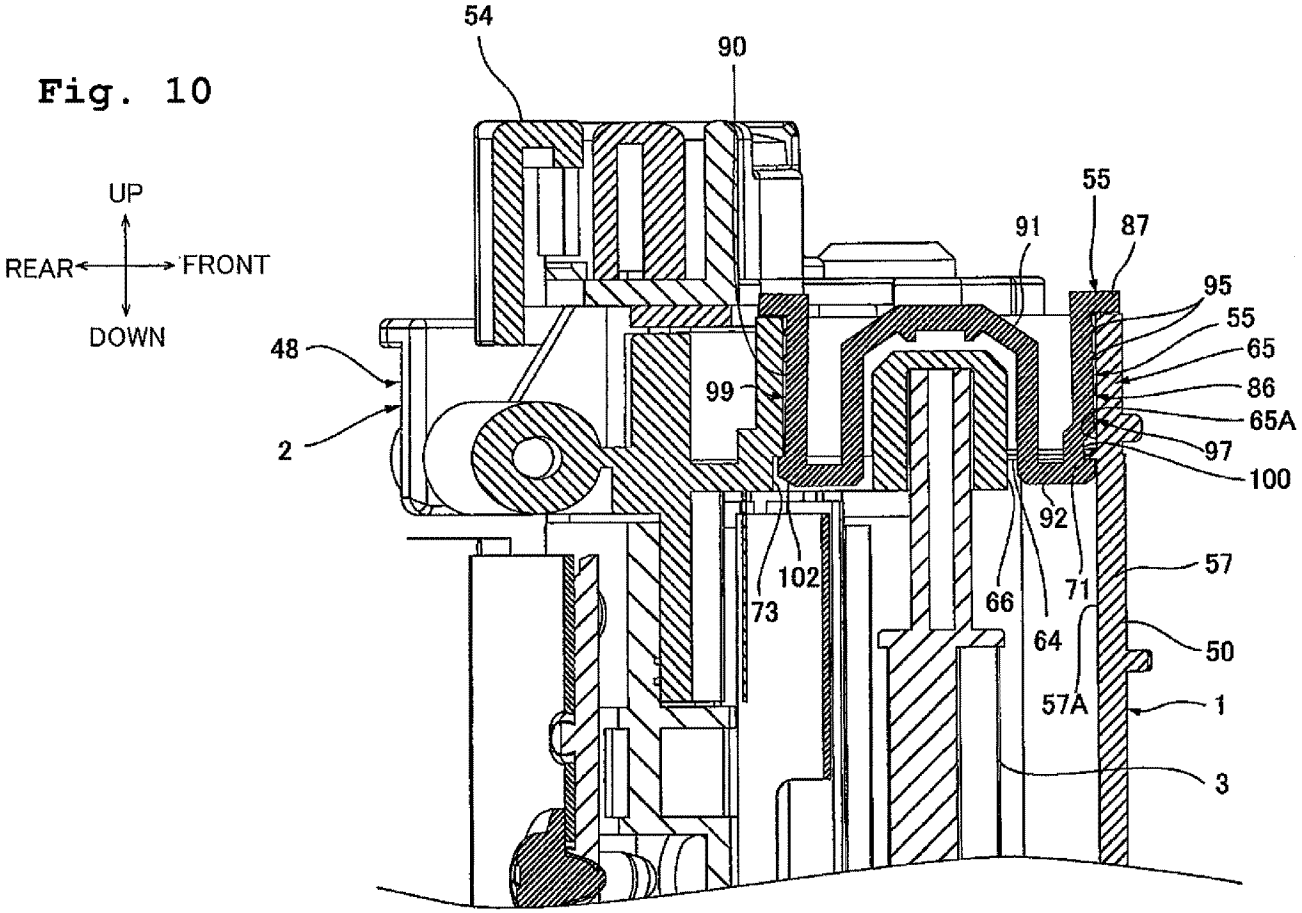
FIG. 10 is yet another cross-sectional view taken along the line A-A of FIG. 5A, which follows FIG. 9 to illustrate the assembly or installation of the toner cap.

The direction concerning the assembly or installation of the toner cap 55 depicted in each of FIGS. 9 and 10 is different from the direction depicted in each of FIGS. 1 to 7. The left-right direction defined in each of FIGS. 1 to 7 is defined as an up-down direction in each of FIGS. 9 and 10. Specifically, the directions depicted by arrows in each of FIGS. 9 and 10 are used as a reference. Further, the direction in which the toner cap 55 is assembled or installed at the time of the assembly or installation of the toner cap 55 is defined as the installation direction. That is, in each of FIGS. 1 to 7, the direction from the right side to the left side is defined as the installation direction, and in each of FIGS. 9 and 10, the direction from the upper side to the lower side is defined as the installation direction.

In order to assemble the toner cap 55 to the cylindrical portion 65, as depicted in FIG. 6, the operator arranges the toner cap 55 on the upstream side of the developing frame 2 in the installation direction.

In this situation, as depicted in FIG. 5A and FIG. 6, the toner cap 55 is arranged such that the inner cylinder 91 of the main body 86 overlaps with the support portion 66, that the outer cylinder 90 of the main body 86 overlaps with the inner circumference of the cylinder portion 65, and that the insertion hole 105 of the fixed portion 88 corresponds to the insertion portion 68 of the right side wall 48, when seen from the installation direction.

Then, as depicted in FIGS. 5A and 5B, the respective three notched grooves 96 of the toner cap 55 overlap with the corresponding connection portions 67 in the cylindrical portion 65. Specifically, the first notched groove 96A overlaps with the first connection portion 67A, the second notched groove 96B overlaps with the second connection portion 67B, and the third notched groove 96C overlaps with the third connection portion 67C.

Subsequently, as depicted in FIG. 9, the toner cap 55 is pushed toward the cylindrical portion 65.

Then, since the second locking portion 102 projects outward in the radial direction beyond the circumferential surface of the third bending portion 99, the third bending portion 99 of the main body 86 is rubbed against the inner circumferential surface of the cylindrical portion 65 in a state of being bent inward of the main body 86 in the radial direction by an amount of projection of the second locking portion 102. Further, the first bending portion 97 is rubbed against the inner circumferential surface of the cylindrical portion 65 without being bent inward of the main body 86 in the radial direction.

Although not depicted, since the first locking portion 101 projects in the radial direction beyond the circumferential surface of the second bending portion 98, the second bending portion 98 of the main body 86 is rubbed against the inner circumferential surface of the cylindrical portion 65 in a state of being bent inward of the main body 86 in the radial direction by an amount of projection of the first locking portion 101.

Subsequently, in a case that the toner cap 55 is further pushed, the downstream end edge of the first bending portion 97 in the installation direction makes contact with the frame protruding portion 71. Since the downstream end edge of the first bending portion 97 in the installation direction is chamfered to allow the upstream surface of the frame protruding portion 71 in the installation direction to be inclined, the first bending portion 97 is pushed in a state of being bent inward of the main body 86 in the radial direction to climb onto the frame protruding portion 71.

Then, in a case that the toner cap 55 is still further pushed, as depicted in FIGS. 1 and 10, the contact of the first locking portion 101 and the second locking portion 102 with the inner circumferential surface of the cylindrical portion 65 is released to restore the second bending portion 98 and the third bending portion 99. Accordingly, the first locking portion 101 gets caught on the corner 72 and the second locking portion 102 gets caught on the multilevel portion 73.

Further, the first bending portion 97 is restored by allowing the downstream end of the first bending portion 97 in the installation direction to climb over the frame protruding portion 71. Thus, the frame protruding portion 71 gets caught on the recessed portion 100.

As described above, the assembly of the toner cap 55 to the cylinder portion 65 is completed.

In this situation, the downstream end surface of the flange 87 in the installation direction is brought into contact with the upstream end surface of the cylindrical portion 65 in the installation direction. Further, by assembling the toner cap 55 to the cylindrical portion 65 such that the ring 95 is brought in contact under pressure with the inner circumferential surface of the cylindrical portion 65, the toner is prevented from leaking from a portion between the outer circumferential surface of the outer cylinder 90 of the main body 86 and the inner circumferential surface of the cylindrical portion 65.

<Action and Effect>

According to the developing cartridge 1 of the above embodiment, as depicted in FIGS. 9 and 10, in a case that the toner cap 55 is installed to the cylinder portion 65, the recessed portion 100 of the first bending portion 97 is engaged with the frame protruding portion 71 which projects inward beyond the inner surface of the cylindrical portion 65.

In order to assemble or install the toner cap 55 to the cylindrical portion 65 reliably, the following configuration is conventionally studied. That is, claws are arranged over the entire circumference of the toner cap 55 and engagement portions for being engaged with the claws of the toner cap 55 are arranged in the developing frame 2. However, in a case that the developing frame 2 is attempted to be downsized while the size of the toner filling port 64 is maintained to secure the filling efficiency of the toner, the inconvenience arises such that the engagement portions for being engaged with the claws of the toner cap 55 can not be arranged in the developing frame 2.

On the other hand, in the developing cartridge 1 of the above embodiment, the frame protruding portion 71 is arranged to project inward beyond the inner surface of the cylindrical portion 65, and thus the toner cap 55 can be installed to the cylindrical portion 65 reliably while the downsizing of the developing cartridge 1 can be achieved.

Further, in the case that the toner cap 55 is installed to the cylindrical portion 65, the occurrence of resistance between the toner cap 55 and the cylindrical portion 65 can be prevented until the downstream end of the toner cap 55 in the installation direction makes contact with the frame protruding portion 71.

As a result, it is possible to install the toner cap 55 to the cylindrical portion 65 easily.

According to the developing cartridge 1 of the above embodiment, as depicted in FIGS. 1 and 10, the toner cap 55 includes, in addition to the recessed portion 100 to be engaged with the frame protruding portion 71, the first locking portion 101 to be engaged with the corner 72 and the second locking portion 102 to be engaged with the multilevel portion 73. Thus, the toner cap 55 can be installed to the cylindrical portion 65 reliably.

Since the toner cap 55 includes the first locking portion 101 and the second locking portion 102, when the toner cap 55 is installed to the cylindrical portion 65, the first locking portion 101 and the second locking portion 102 are rubbed against the inner circumferential surface of the cylindrical portion 65 in a state of being brought in contact therewith, as depicted in FIG. 9. Regarding the portion at which the recessed portion 100 is arranged, the occurrence of resistance is prevented. Thus, the toner cap 55 can be assembled to the cylindrical portion 65 more easily when compared with a case in which the first locking portion 101 and the second locking portion 102 are provided over the entire toner cap 55.

According to the developing cartridge 1 of the above embodiment, as depicted in FIG. 4, the right side wall 48 includes the multilevel portion 73 and the corner 72 at the periphery of the toner filling portion 64, the multilevel portion 73 being recessed beyond the inner surface of the cylindrical portion 65 in the direction perpendicular to the installation direction, the corner 72 being formed of the connection portion between the cylindrical portion 65 and the developing frame 2.

Therefore, as depicted in FIG. 1, the first hooking portion 101 of the toner cap 55 can be engaged with the corner 72 reliably, and the second holing portion 102 can be engaged with the multilevel portion 73 reliably.

As a result, the toner cap 55 can be installed to the cylindrical portion 65 more reliably.

According to the developing cartridge 1 of the above embodiment, as depicted in FIG. 9, the recessed portion 100 and the second hooking portion 102 are arranged to mutually deviate in the installation direction. Although not depicted, the recessed portion 100 and the first hooking portion 101 are arranged to mutually deviate in the installation direction.

Accordingly, when the toner cap 55 is installed to the cylindrical portion 65, the resistance is allowed to occur at different timings.

As a result, it is possible to reduce the resistance caused when the tonner cap 55 is installed to the cylindrical portion 65.

According to the developing cartridge 1 of the above embodiment, the toner cap 55 includes the notched grooves 96 as depicted in FIG. 7A to 7D. Thus, as depicted in FIG. 9, the portion at which the resistance occurs at the time of installation of the toner cap 55 into the cylindrical portion 65 is allowed to bend toward the notched grooves 96.

Accordingly, it is possible to reduce the resistance caused when the toner cap 55 is installed to the cylindrical portion 65.

According to the developing cartridge 1 of the above embodiment, as depicted in FIG. 5A, the toner cap 55 can be installed to the cylindrical portion 65 reliably by inserting the insertion portion 68 of the developing frame 2 through the insertion hole 105 of the fixed portion 88 and fixing the fixed portion 88 to the developing frame 2.

Figure 7A:
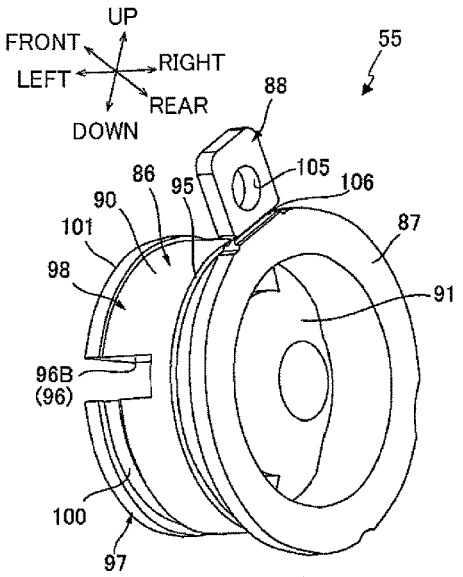
FIG. 7A is a perspective view of the toner cap depicted in FIG. 3 as viewed from a right frontward position.
Figure 7B:
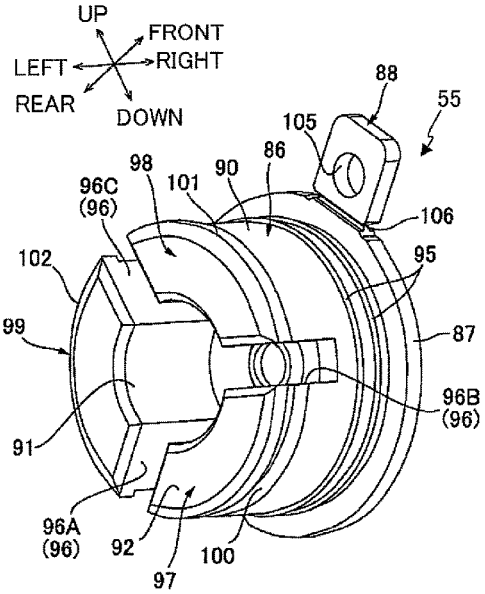
FIG. 7B is a perspective view of the toner cap depicted in FIG. 3 as viewed from a left frontward position.
Figure 7C:
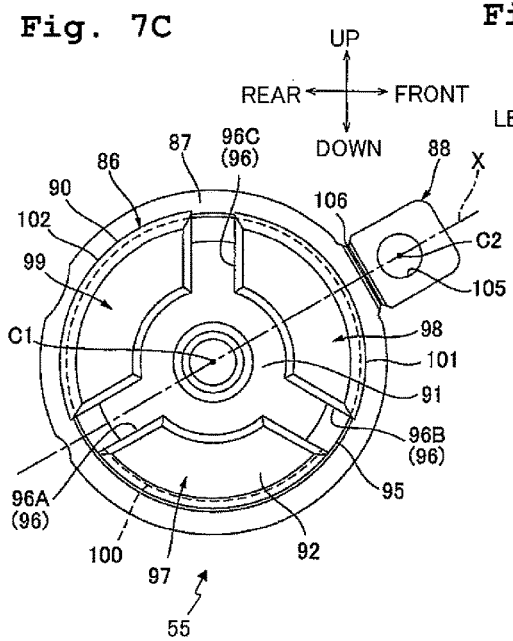
FIG. 7C is a left-side view of the toner cap depicted in FIG. 3.
Figure 7D:
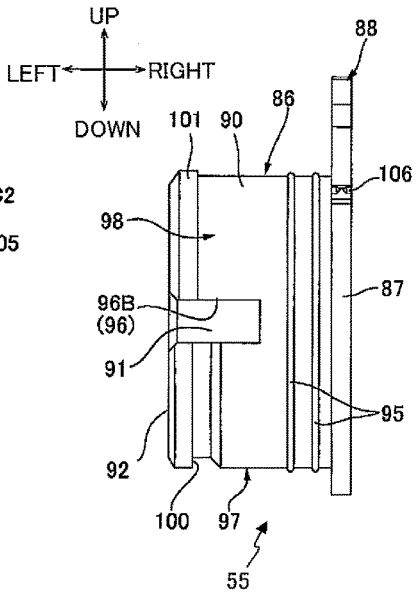
FIG. 7D is a front view of the toner cap depicted in FIG. 3.

As depicted in FIG. 7C, the recessed portion 100, the first hooking portion 101, and the second hooking portion 102 of the toner cap 55 are arranged non-linear symmetrically with respect to a virtual line X passing through the fixed portion 88 and dividing the toner cap 55 into two pieces. More specifically, there are many portions which project outward of the main body 86 in the radial direction on one side with respect to the virtual line X, and there are many portions which are recessed inward of the main body 86 in the radial direction on the other side with respect to the virtual line X. Therefore, in a case that the toner cap 55 is removed or extracted from the cylindrical portion 65, the fixed portion 88 is twisted and disengaged in a state that the fixed portion 88 remains fixed to the developing frame 2, so that the toner cap 55 is removed from the cylindrical portion 65.

Therefore, in a case that the developing frame 2 is out of toner, the toner cap 55 can be removed from the cylindrical portion 65 easily. Even in this case, the fixed portion 88 remains fixed to the insertion portion 68 of the developing frame 2. Thus, whether or not the developing frame 2 was filled with the toner in the past can be confirmed.

According to the developing cartridge 1 of the above embodiment, as the developing cartridge 1 is viewed from the installation direction, the area where the frame protruding portion 71 is arranged is smaller than the areas where the corner 72 and the multilevel portion 73 are respectively arranged, in the inner surface of the cylindrical portion 65, as depicted in FIG. 5B.

Thus, as depicted in FIG. 8, in a case that the developing frame 2 is filled with the toner, the toner can be prevented from making contact with a portion which projects inward in the radial direction beyond the inner surface of the cylindrical portion 65.

As a result, the developing frame 2 can be filled with the toner easily without the decrease in the efficiency of filling of toner into the developing frame 2.

According to the developing cartridge 1 of the above embodiment, as depicted in FIG. 9, the frame protruding portion 71 is inclined inward of the cylindrical portion 65 toward the downstream side in the installation direction. Thus, it is possible to reduce the resistance caused by the contact between the toner cap 55 and the frame protruding portion 71 at the time of installation of the toner cap 55 to the cylindrical portion 65.

Therefore, the toner cap 55 can be assembled to the cylindrical portion 65 smoothly.

In a case that the developing frame 2 is filled with the toner, as depicted in FIG. 8, the toner is allowed to flow therein along the inclination or slope of the frame protruding portion 71. Thus, the filling efficiency can be improved.

According to the developing cartridge 1 of the above embodiment, as depicted in FIG. 10, the lower ends of the toner cap 55 in the installation direction are flush with each other in the direction perpendicular to the installation direction. Thus, the lower ends of the toner cap 55 in the installation direction as a whole are allowed to come close to a member, such as the agitator 3, arranged downstream in the installation direction in a state that the toner cap 55 is installed.

According to the developing cartridge 1 of the above embodiment, as depicted in FIG. 10, the toner cap 55 is installed to the cylindrical portion 65, and thereby making it possible to secure the strength of the cylindrical portion 65. Thus, the downsizing of the developing cartridge 1 can be achieved by making the thickness of the cylindrical portion 65 thinner.

According to the developing cartridge 1 of the above embodiment, as depicted in FIG. 5B, the developing cartridge 1 can be prevented from having a large size by arranging the electrode member 54 to be adjacent to the cylindrical portion 65.

<Modifications>

The developing cartridge 1 as described above is an embodiment of the cartridge of the present teaching, and the present teaching is not limited to the embodiment.

Instead of the cylindrical portion 65 having the substantially cylindrical shape, it is possible to adopt, for example, inlet portions having a substantially rectangular-shaped cross section, a substantially triangular-shaped cross section, and a substantially elliptical-shaped cross section, respectively.

Instead of the toner cap 55, it is possible to adopt, for example, lid members having a substantially rectangular-shaped cross section, a substantially triangular-shaped cross section, and a substantially elliptical-shaped cross section, respectively, so that the cross-section of the lid member corresponds to the cross-section of the inlet portion.

As described in the embodiment and the modified embodiments, the lid member may include a second protruding portion which projects from the outer surface of the lid member in the direction perpendicular to the installation direction and an engagement portion configured to be engaged with the second protruding portion in the case that the lid member is installed to the inlet portion.

According to this structure, the lid member includes, in addition to the recessed portion to be engaged with the first protruding portion, the second protruding portion to be engaged with the engagement portion. Thus, the lid member can be installed to the inlet portion reliably.

Since the lid member includes the second protruding portion, in the case that the lid member is installed to the inlet portion, the second protruding portion is rubbed against the inner surface of the inlet portion in a state of being brought in contact therewith. However, the occurrence of resistance is prevented at a portion where the recessed portion is arranged, and thus the lid member can be assembled to the inlet portion more easily as compared with a case in which the second protruding portion is provided over the entire lid member.

In the embodiment and the modified embodiments, the engagement portion may be a multilevel portion which is recessed beyond the inner surface of the inlet portion in the direction perpendicular to the installation direction and/or a corner which is formed by a connection portion between the inlet portion and the casing.

According to this structure, since the engagement portion is the multilevel portion and/or the corner, the second protruding portion of the lid member can be engaged with the engagement portion securely.

As a result, the lid member can be installed to the inlet portion more securely.

In the embodiment and the modified embodiments, the recessed portion and the second protruding portion may be arranged to mutually deviate in the installation direction.

According to this structure, since the recessed portion and the second protruding portion are arranged to mutually deviate in the installation direction, in the case that the lid member is installed to the inlet portion, the resistance is allowed to occur at different timings.

As a result, it is possible to reduce the resistance to be caused when the lid member is installed to the inlet portion.

In the embodiment and the modified embodiments, the lid member may include a notched groove which is formed by cutting an area, in the lid member, ranging from the downstream end in the installation direction toward an upstream side in the installation direction.

According to this structure, since the lid member includes the notched groove, a portion at which the resistance occurs at the time of installation of the lid member into the inlet portion is allowed to bend toward the notched groove.

Therefore, it is possible to further reduce the resistance to be caused when the lid member is installed to the inlet portion.

In the embodiment and the modified embodiments, the lid member may include a fixed portion which projects outward beyond the outer surface of the inlet portion in a state of being installed to the inlet portion and is fixed to the casing, and the recessed portion and the second protruding portion of the lid member may be arranged non-linear symmetrically, when being projected from the installation direction, with respect to a virtual line which passes through the fixed portion to divide the lid member into two pieces.

According to this structure, since the fixed portion is fixed to the casing, the lid member can be installed to the inlet portion reliably.

In a case that the lid member is removed or extracted from the inlet portion, the fixed portion remains fixed to the casing. Meanwhile, since the recessed portion and the second protruding portion of the lid member are arranged non-linear symmetrically with respect to the virtual line which passes through the fixed portion to divide the lid member into two pieces, when the fixed portion is twisted, the fixed portion is disengaged to remove the lid member from the inlet portion.

Since the lid member can be removed from the inlet portion easily in a state that the fixed portion remains fixed to the casing, it is possible to confirm whether or not the casing was filled with the developer in the past when the casing is out of the developer.

In the embodiment and the modified embodiments, an area, in the inner surface of the inlet portion, where the first protruding portion is arranged may be smaller than an area, in the inner surface of the inlet portion, where the engagement portion is arranged, as the casing is viewed from the installation direction.

According to this structure, the developer can be prevented from contacting with the first protruding portion in a case that the casing is filled with the developer.

Therefore, the casing can be filled with the developer easily without the decrease in the efficiency of filling of developer into the casing.

In the embodiment and the modified embodiments, the first protruding portion may be inclined inward of the inlet portion toward a downstream side in the installation direction.

According to this structure, it is possible to reduce the resistance to be caused by the contact between the lid member and the first protruding portion at the time of the installation of the lid member into the inlet portion.

Therefore, the lid member can be assembled to the inlet portion smoothly.

In a case that the casing is filled with the developer, the developer is allowed to flow therein along the inclination or slope of the first protruding portion. Thus, the filling efficiency can be improved.

In the embodiment and the modified embodiments, the lower ends of the lid member in the installation direction may be flush with each other in the direction perpendicular to the installation direction.

According to this structure, the lower ends of the lid member in the installation direction as whole are allowed to come close to a member arranged downstream in the installation direction in a state that the lid member is installed.

In the embodiment and the modified embodiments, a thickness of the inlet portion may be thinner than a thickness of a wall of the casing to which the inlet portion is connected.

According to this structure, the lid member is installed to the inlet portion, and thereby making it possible to secure the strength of the inlet portion. Thus, the downsizing of the cartridge can be achieved by making the thickness of the inlet portion thinner.

In the embodiment and the modified embodiments, the cartridge may include a functional component to be assembled to the casing. The functional component may be arranged adjacent to the inlet portion in the direction perpendicular to the installation direction.

According to this structure, the cartridge can be prevented from having a large size by arranging the functional component to be adjacent to the inlet portion.

In the cartridge of the present teaching, the lid member can be easily assembled to the inlet portion for filling the casing with the developer.

What is claimed is:

1. A cartridge configured to contain a developer, comprising:

a casing including an inlet portion configured to be filled with the developer; and a lid member configured to close the inlet portion by being installed to the inlet portion from an installation direction, and having a first area and a second area circumferentially distinct from the first area as viewed from the installation direction, wherein the casing includes a first protruding portion which projects inward beyond an inner surface of the inlet portion in a direction perpendicular to the installation direction;

wherein the second area of the lid member includes a recessed portion which is recessed from an outer surface of the lid member in the direction perpendicular to the installation direction and which is configured to be engaged with the first protruding portion in a case that the lid member is installed to the inlet portion, the recessed portion including a groove formed in the outer surface of the lid member extending in a circumferential direction of the lid member;

wherein the first area of the lid member includes a second protruding portion which projects from the outer surface of the lid member in the direction perpendicular to the installation direction;

wherein the casing includes an engagement portion which is engaged with the second protruding portion in the case that the lid member is installed to the inlet portion;

wherein the lid member has the second protruding portion and does not have a recessed portion in the first area, and the lid member has the recessed portion and does not have a second protruding portion in the second area; and wherein as viewed from the installation direction, the second protruding portion and the recessed portion are arranged asymmetrically with respect to an imaginary center line which is a center line of the lid member and is parallel to the installation direction.

2. The cartridge according to claim 1, wherein the engagement portion includes at least one of a multilevel portion which is recessed beyond the inner surface of the inlet portion in the direction perpendicular to the installation direction and a corner which is formed by a connection portion between the inlet portion and the casing.

3. The cartridge according to claim 1, wherein the recessed portion and the second protruding portion are arranged to mutually deviate in the installation direction.

4. The cartridge according to claim 1, wherein the groove extends from a downstream end in the installation direction to an upstream side in the installation direction.

5. The cartridge according to claim 1, wherein the lid member includes a fixed portion which projects outward beyond an outer surface of the inlet portion in a state of being installed to the inlet portion and is fixed to the casing, and the recessed portion and the second protruding portion of the lid member are arranged non-linear symmetrically, when being projected from the installation direction, with respect to a virtual line which passes through the fixed portion to divide the lid member into two pieces.

6. The cartridge according to claim 1, wherein a ratio of an area where the first protruding portion is arranged to the inner surface of the inlet portion is smaller than a ratio of an area where the engagement portion is arranged to the inner surface of the inlet portion, as the casing is viewed from the installation direction.

7. The cartridge according to claim 1, wherein the first protruding portion includes a slope inclined inward of the inlet portion toward a downstream side in the installation direction.

8. The cartridge according to claim 1, wherein lower ends of the lid member in the installation direction are flush with each other in the direction perpendicular to the installation direction.

9. The cartridge according to claim 1, wherein a thickness of the inlet portion is thinner than a thickness of a wall of the casing to which the inlet portion is connected.

10. The cartridge according to claim 1, further comprising a functional component to be assembled to the casing, wherein the functional component is arranged adjacent to the inlet portion in the direction perpendicular to the installation direction.

11. The cartridge according to claim 7, wherein the first protruding portion includes a slope inclined outward of the inlet portion toward an upstream side in the installation direction.

12. The cartridge according to claim 1, wherein an opposite surface, of the casing, opposite to a surface on which the first protruding portion projects is exposed outward.

13. The cartridge according to claim 1, wherein the lid member is made of a resin.

14. The cartridge according to claim 1, wherein the inlet portion has a substantially cylindrical shape.

15. The cartridge according to claim 1, wherein the shape of the lid member corresponds to a cross-sectional shape of the inlet portion.

16. A lid member for a cartridge including a casing which includes an inlet portion configured to be filled with the developer, the lid member comprising:

a lid configured to close the inlet portion by being installed to the inlet portion from an installation direction, and having a first area and a second area circumferentially distinct from the first area as viewed from the installation direction, wherein the casing includes a first protruding portion which projects inward beyond an inner surface of the inlet portion in a direction perpendicular to the installation direction, and an engagement portion which is engaged with the lid, wherein the lid includes:

a recessed portion which is recessed from an outer surface of the lid in the direction perpendicular to the installation direction, and which is configured to be engaged with the first protruding portion in a case that the lid is installed to the inlet portion, the recessed portion including a groove formed in the outer surface of the second area of the lid extending in a circumferential direction of the lid;

a second protruding portion which projects from the outer surface of the first area of the lid in the direction perpendicular to the installation direction, and is configured to be engaged with the engagement portion in the case that the lid is installed to the inlet portion, and wherein the second area in the lid where the recessed portion is arranged is smaller than the first area of the lid where the second protruding portion is arranged;

wherein the lid has the second protruding portion and does not have a recessed portion in the first area, and the lid has the recessed portion and does not have a second protruding portion in the second area; and wherein as viewed from the installation direction, the second protruding portion and the recessed portion are arranged asymmetrically with respect to an imaginary center line which is a center line of the lid member and is parallel to the installation direction.

* * * * *